US006328171B1

(12) United States Patent
Coppel

(10) Patent No.: US 6,328,171 B1
(45) Date of Patent: Dec. 11, 2001

(54) MULTIPLE MEDAL HOLDER

(76) Inventor: Wayne Marc Coppel, 9717 NW. Silver Ridge, Portland, OR (US) 97229

( * ) Notice: Subject to any disclaimer, the term of this patent is extended or adjusted under 35 U.S.C. 154(b) by 0 days.

(21) Appl. No.: 09/598,765

(22) Filed: Jun. 22, 2000

(51) Int. Cl.[7] ..... A47F 7/00

(52) U.S. Cl. ..... 211/85.2; 211/13.1; 248/303; D8/372; 206/6.1; 24/370; 24/907

(58) Field of Search ..... 211/85.2, 13.1; 206/6.1; 24/370, 377, 907; D8/370, 371, 372; 248/301, 303

(56) References Cited

U.S. PATENT DOCUMENTS

D. 319,002 * 8/1991 Minza et al. .
D. 367,384 * 2/1996 DiFranco et al. .
D. 374,171 * 10/1996 Protz ..... D8/371 X
1,945,585 * 2/1934 Wintrob .
2,695,151 * 11/1954 Lord .
2,905,328 * 9/1959 Munao et al. .
3,792,543 * 2/1974 Powell .
5,118,171 * 6/1992 Ortiz .
5,160,049 * 11/1992 McMillen ..... 211/85.2
5,353,921 * 10/1994 Tyra .
5,782,022 * 7/1998 Tubberville .

* cited by examiner

*Primary Examiner*—Robert W. Gibson, Jr.

(57) ABSTRACT

A plurality of medals with attached neck-ribbons are displayed on a multiple display holder that includes a display board (10) having a plurality of slot (11) and aperture (13) pairs. A hook-clip (14), used for securing the medal and its neck ribbon to the display board and formed from a unitary length of wire made of metal or other material, has a small "u"-shaped hook portion (18) at one end and a large "u"-shaped clip portion (19) at its opposite end. The hook-clip is inserted through a selected aperture s,o that the hook portion protrudes from the front face of the display board and the clip portion protrudes from the back side of the board. When the neck ribbon attached to a medal is inserted through the slot associated with the selected aperture, the hook portion on the front face of the board provides a hook onto which the medal can be hung while the clip portion on the back side of the board provides a region (22) within which the ribbon can be held when it is wound-up or otherwise gathered. The display board can be configured in various ways and made of various materials and can be wall or table mounted. Multiple boards can be affixed together to form a freestanding multi-board, three-dimensional device.

6 Claims, 2 Drawing Sheets

MULTIPLE MEDAL HOLDER

BACKGROUND OF THE INVENTION

1. Field of the Invention

The present invention relates to a medal holder that holds, organizes and displays award-type medals. More specifically, the present invention relates to a medal holder that displays medals having attached neck-ribbons.

2. Prior Art

While several different holders are known for jewelry, belts and neckties, there is a need for a medal holder that is simple to manufacture, firmly secures the medal, yet provides easy access to a plurality of medals having attached neck-ribbons.

One type of medal display rack, shown in U.S. Pat. No. D0260207 to Nutting, is in the form of a table mounted tiered display that neither securely mounts the neck-ribbons nor provides a mechanism for securing the medals tightly in-place.

One type of hanger for belts, described in U.S. Pat. No. 2,598,614 to Gilbert, proposes angular apertures or slots to hang belts with buckles. The neck-ribbon affixed to a medal is very lightweight compared to that of the medal and this type of hanger could not be used to display multiple medals of various sizes.

Another type of hanger, described in U.S. Pat. No. 4,90146 to Kolton et al., uses wider slots for hanging suspenders, and yet other types of holders use various types of apertures for displaying various types of neckties, jewelry and keys as follows:

| U.S. Pat. No. | Inventor | Title |
|---|---|---|
| 3,653,515 | Rice | Tie Rack |
| 3,118,541 | McKeever | Necktie Rack |
| 3,705,653 | Pereya | Necktie Rack |
| 3,783,995 | Tobin | Tie Rack |
| 3,945,500 | Meckstroth | Necktie Hanger |
| 5,526,968 | Larson | Hanger Valet |
| 3,081,881 | Seeger | Haberdashery Hanger |
| 5,762,184 | Greiner | Jewelry Holder with at Least One Movable Stand |
| 5,067,617 | Caldwell | Earring Storage and Display Rack |
| 3,997,219 | Phelps | Jewelry Cabinet |
| 3,070,235 | Manzardo | Key Filing System |
| D0137,945 | Geller et al. | Design for a Display Rack |

Again, a problem with these hangers, displays and racks is that they can not securely mount and easily display a plurality of various-sized and weighted medals having attached neck-ribbons in a holder board that can be both wall-mounted and table-mounted.

SUMMARY OF THE INVENTION

The present invention holds and displays a plurality of medals with attached neck-ribbons by means of a display board having a plurality of slot and aperture pairs. A hook-clip, used for securing the medal and its attached neck ribbon to the display board, is formed from a unitary length of wire made of metal or other material having a small "u"-shaped hook portion at one end and a large "u"-shaped clip portion at its opposite end. In one embodiment, the hook-clip has an intermediate arcuate portion between the hook and clip portions. Further, in this embodiment the distal end of the clip-portion is flattened to enable a user to easily insert the hook-clip through an aperture in the display board. The hook-clip is inserted through a selected aperture so that the hook portion protrudes from the front face of the display board and the clip portion protrudes from the back side of the board. When the neck ribbon attached to a medal is inserted through the slot associated with the selected aperture, the hook portion on the front face of the board provides a hook onto which the medal can be hung while the clip portion on the back side of the board provides a region within which the ribbon can be held when it is wound-up or otherwise gathered. The display board can be produced in many configurations, shapes and sizes to accommodate a plurality of medals that have attached neck-ribbons. Thus, for example, the display board may need not be planar. Further, multiple display boards, planar or otherwise, can be configured together to form a multi-board, freestanding three-dimensional medal holder.

A fuller understanding of this invention may be had by referring to the following description and claims, taken in conjunction with the accompanying drawings.

DETAILED DESCRIPTION

Figure 1:
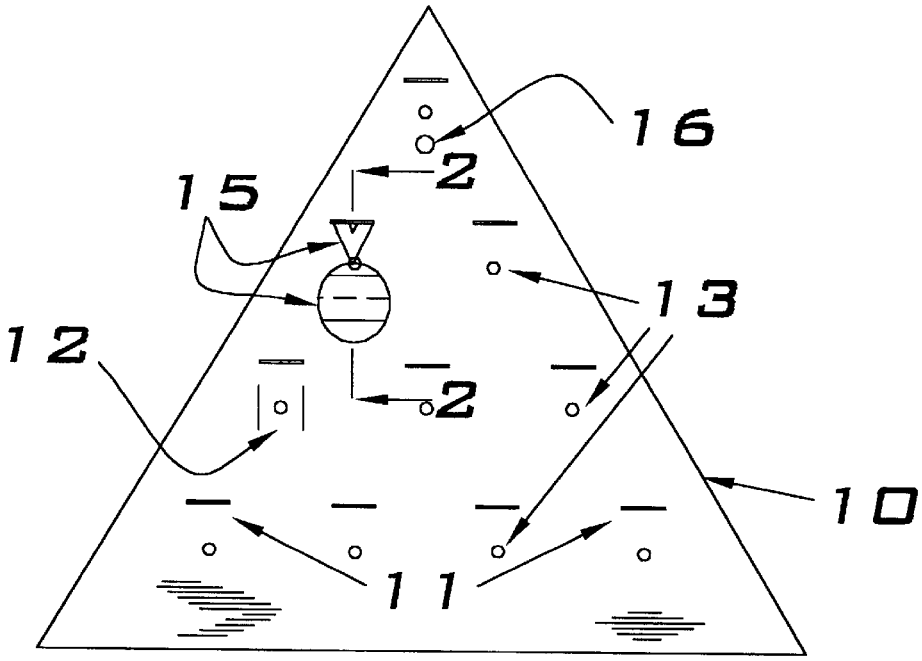
FIG. 1 is a front elevation of one embodiment of the multiple medal holder device in accordance with the present invention.

The multiple medal holder of the present invention is designed for holding and displaying a plurality of award medals with attached neck-ribbons. As shown in the drawings, the preferred medal holder device in accordance with the present inventions includes a display board 10. Although the drawing in FIG. 1 shows an embodiment in which the display board is a planar board in the shape of a triangle, the board can be any configuration, shape and dimension. The board can be made of opaque or clear material including but not limited to plastic, acrylic resin or a plastic consisting essentially of polymerized methyl methacrylate, wood, glass, ceramic or metal. Furthermore, the board need not be planar as shown in the embodiment of FIG. 1 but can be three-dimensionally shaped to be self-standing. The board includes a plurality of slots 11 with an opening having a thickness that will enable typical neck-ribbons to be laced through the slots. The width 12 of the slots is chosen to be wide enough to accommodate a typical neck-ribbon. An aperture 13 is spatially associated with and disposed below each slot 11 so that each slot and associated aperture form a pair.

Figure 2:
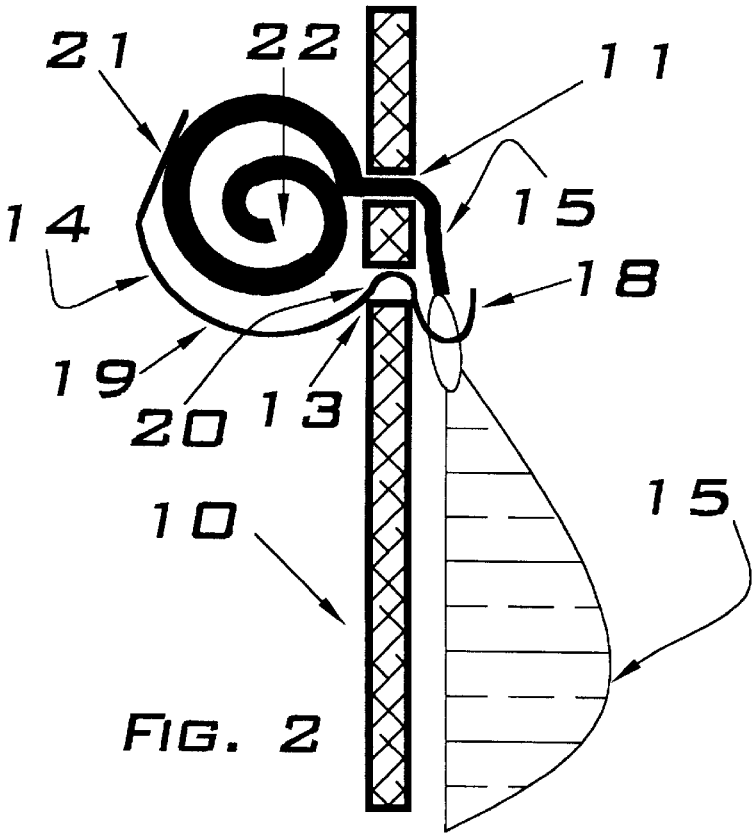
FIG. 2 is a fragmentary sectional view along the line 2—2 of FIG. 1.

Each aperture 13 has a diameter large enough to accept a hook-clip 14, shown in a cross-sectional view in FIG. 2. A hook-clip may be inserted at the time of manufacture in each aperture 13. Alternatively and preferably, a plurality of loose hook-clips will be packaged with the display board for individual insertion by the end-user as he or she wishes to display a newly won medal on the multiple display board 10.

With reference to FIG. 2, a fragmented cross-sectional view shows a hook-clip 14 inserted through an aperture 13 and a medal with neck-ribbon 15 in the slot 11 associated with that aperture. The hook-clip 14 has three sections consisting of a small "u"-shaped hook section 18 (0.25" nominal) at one end of the hook-clip, a large "u"-shaped clip section 19 (1.0" nominal) at the distal end of the hook-clip, and an arcuate interstitial section 20 (0.25" nominal) between the hook and clip sections. The hook-clip 14 can be fabricated from a flexible or rigid metal wire or other material that has sufficient tensile strength to support the weight of a typical medal. As an example, the hook-clip can be made from a flexible hard-drawn spring or stainless steel wire having a nominal diameter of 35/1000", or from a bright basic steel paper-clip type of wire also having a nominal diameter of 35/1000". In order to facilitate insertion of the hook-clip through the aperture 13, the hook-clip 14 is fabricated to have a substantially flat portion 21 (0.5" nominal) at the end of the large "u"-shaped clip section 19.

The end-user affixes the hook-clip 14 to the display board 10 by inserting the flat end 21 of the hook-clip 14 into the aperture 13 from the front face and then threading the remainder of the clip end through that aperture until the arcuate interstitial section 20 of the hook-clip 14 rests in the aperture 13. The "u"-shaped hook section 18 then extends forward from the front face of the display board 10, providing a hook onto which the body of the medal is hung. The large "u"-shaped clip section 19 extends outward from the back face of the board, providing, in combination with the back surface of the display board 10, a region 22 within which the rolled-up or otherwise gathered neck ribbon, which has been inserted through the slot 11, can be held. Depending upon the type of material used for the hook-clip, the clip portion can either be sprung away in order to place the ribbon in the region 22 or it can be bent and then re-shaped as one would bend a paper-clip. The arcuate interstitial section 20 of the hook-clip can also be the pivot point between the hook section 18 and clip section 19 whereby the weight of the medal on the hook pivots the clip portion to hold the ribbon.

Figure 3:
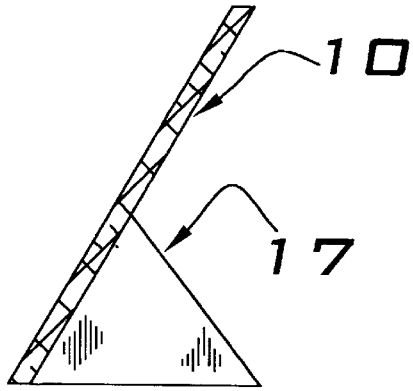
FIG. 3 is a side view of one embodiment of the multiple medal holder device.

The multiple medal holder of the present invention can be displayed on a table, shelf or other surface by means of a stand 17 affixed to the back side of the display board, as shown in the side view of the embodiment in FIG. 3. The stand 17 can be formed separately from the display board and permanently or detachable attached thereto and arranged to support the display board at a selected angle relative to a horizontal surface. Alternatively, the display board and stand can be fabricated as an integral unit that includes a stand portion for supporting the display board on a horizontal surface. Further, the display board can be fabricated in a non-planar shape that enables it to be free-standing on a horizontal surface. In the absence of an integral board-stand, a center aperture 16 can provided through the upper portion of the board 10 for attaching the holder to a vertical surface such as a wall or door by means of fasteners (not shown).

Figure 4:
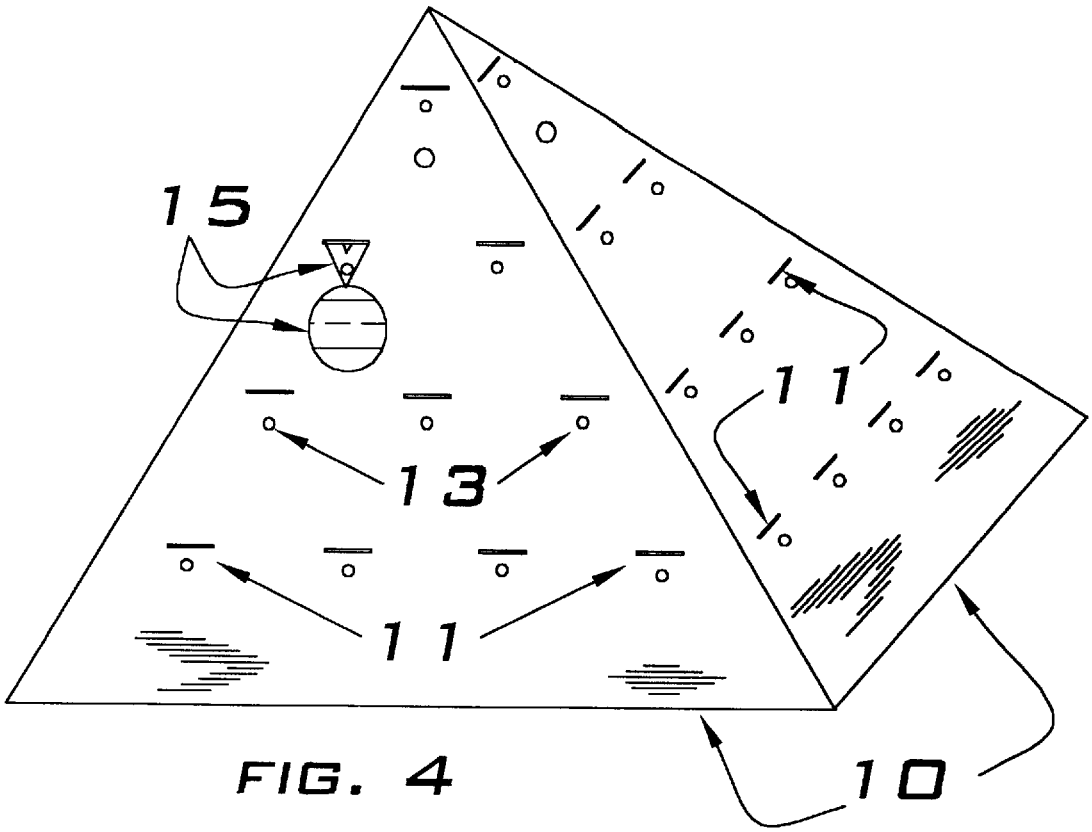
FIG. 4 is a side view of one embodiment of a multi-board, three dimensional multiple medal holder device.

FIG. 4 shows an example of an embodiment of three separate boards 10 (only two are visible in the figure) in a triangular configuration affixed to each other to form a multi-board, freestanding three-dimensional device. Depending on the shapes of the display boards, various other three-dimension configurations can be achieved using multiple display boards of the same or different shapes.

The above-described embodiments are illustrative of the principles of the present invention. Other embodiments could be devised by those skilled in the art without departing from the spirit and scope of the present invention.

What is claimed:

1. Apparatus comprising a display board having a plurality of slot and aperture pairs, and a plurality of hook-clips, each hook-clip having a hook portion and a clip portion and being shaped such that when the hook-clip is inserted through a selected aperture so that the hook portion protrudes from a front face of the display board and the clip portion protrudes from a rear face of the display board and a neck ribbon attached to a medal is inserted through the slot associated with the selected aperture, the hook portion provides a hook onto which the medal can be hung and the clip portion provides a region within which the neck ribbon can be held.

2. Apparatus in accordance with claim 1 wherein the hook-clip comprises a small "u"-shaped hook portion at one end of the hook-clip, a larger "u"-shaped clip portion at the distal end of the hook-clip, and an arcuate interstitial portion connecting the hook and clip portions.

3. Apparatus in accordance with claim 2 wherein the clip portion has a flattened region at the distal end of the hook-clip.

4. Apparatus comprising:

a plurality of display boards affixed together to form a three-dimensional unitary structure, at least two of said display boards having a plurality of slot and aperture pairs; and a plurality of hook-clips, each hook-clip having a hook portion and a clip portion and being shaped such that when the hook-clip is inserted through a selected aperture in one of said display boards so that the hook portion protrudes from a front face of the one display board and the clip portion protrudes from a rear face of the one display board and a neck ribbon attached to a medal is inserted through the slot associated with the selected aperture, the hook portion provides a hook onto which the medal can be hung and the clip portion provides a region within which the neck ribbon can be held.

5. A hook-clip comprising a small "u"-shaped hook portion, a larger "u"-shaped clip portion, and an interstitial arcuate portion between the hook and clip portions, the hook and clip portions being positioned with respect to each other through the interstitial arcuate portion such that when the hook-clip is inserted through an aperture in a display board so that the hook portion protrudes from a front face of the display board and the clip portion protrudes from a rear face of the display board, the hook portion provides a hook onto which a medal can be hung and the clip portion provides a region within which a neck ribbon attached to the medal which has been inserted through a slot in the display board can be held, the "u"-shaped hook portion and the "u"-shaped clip portion having mouths that are dimensioned so that when the hook-clip is inserted through the aperture in the display board the distance the clip portion protrudes from the rear face of the display board is significantly larger than the distance the hook portion protrudes from the front face of the display board.

6. The hook-clip in accordance with claim 5 wherein the clip portion has a flattened region at the distal end of the hook-clip.

* * * * *